US010058769B1

(12) United States Patent
Schmitcke

(10) Patent No.: US 10,058,769 B1
(45) Date of Patent: Aug. 28, 2018

(54) BINGO CARD HOLDER SYSTEM

(71) Applicant: Jerry Schmitcke, Menoken, ND (US)

(72) Inventor: Jerry Schmitcke, Menoken, ND (US)

( * ) Notice: Subject to any disclaimer, the term of this patent is extended or adjusted under 35 U.S.C. 154(b) by 0 days.

(21) Appl. No.: 15/728,895

(22) Filed: Oct. 10, 2017

(51) Int. Cl.
*A63F 9/00* (2006.01)
*A63F 3/00* (2006.01)
*A63F 3/06* (2006.01)

(52) U.S. Cl.
CPC ..... *A63F 3/00895* (2013.01); *A63F 3/062* (2013.01)

(58) Field of Classification Search
CPC ..... A63F 9/00
USPC ..... 273/309
See application file for complete search history.

(56) References Cited

U.S. PATENT DOCUMENTS 3,810,323 A * 5/1974 Lowe ..... A63F 3/06 273/287
3,811,680 A * 5/1974 Benesch ..... A63F 3/06 273/240
4,241,921 A * 12/1980 Miller ..... A63F 3/06 211/11
4,291,882 A * 9/1981 Del Monte ..... A63F 3/06 273/148 A
D271,895 S 12/1983 Runions
4,555,084 A * 11/1985 Anderson ..... A47B 25/00 108/12
4,618,151 A * 10/1986 Fadner ..... A63F 3/06 273/148 A
4,630,830 A * 12/1986 Gadd ..... A63F 3/0625 273/240
4,767,119 A * 8/1988 Fadner ..... A63F 3/06 273/148 A
4,795,162 A * 1/1989 Rhetts ..... A63F 3/06 248/451
4,948,139 A * 8/1990 Heeszel ..... A45C 9/00 190/10
5,028,048 A * 7/1991 Watson ..... A63F 3/06 190/110
5,054,783 A * 10/1991 Hull ..... A45C 9/00 190/11
D333,160 S * 2/1993 Collins ..... D19/78
5,213,326 A * 5/1993 Rundell ..... A63F 3/06 273/148 A
5,286,025 A * 2/1994 Mulyca ..... A63F 3/0625 273/148 A (Continued)

FOREIGN PATENT DOCUMENTS

WO 1996009098 A1 3/1996

*Primary Examiner* — John E Simms, Jr.
*Assistant Examiner* — Dolores Collins
(74) *Attorney, Agent, or Firm* — Kyle A. Fletcher, Esq.

(57) ABSTRACT

The bingo card holder system is configured for use in a game of bingo. The game of bingo further comprises one or more bingo cards and a plurality of bingo markers. The bingo card holder system organizes the one or more bingo cards. The bingo card holder system displays each of the one or more bingo cards. The bingo card holder system secures each of the one or more bingo cards in a fixed position during game play. The bingo card holder system comprises a master surface and a fastening loop. The master surface is a modular structure that receives, displays and secures the one or more bingo cards such that the position of each of the one or more bingo cards does not shift during game play. The fastening loop is used to truss the modules of the master surface during storage.

15 Claims, 6 Drawing Sheets

(56) References Cited

U.S. PATENT DOCUMENTS

| | | | | | |
|---|---|---|---|---|---|
| D353,623 | S | * | 12/1994 | Jones | D19/85 |
| 5,495,947 | A | * | 3/1996 | Zarske | A63F 3/062 206/315.1 |
| D386,324 | S | | 11/1997 | Degen | |
| 5,868,246 | A | * | 2/1999 | Westfall | A63F 3/061 206/315.1 |
| 6,095,524 | A | * | 8/2000 | Richter | A63F 3/062 273/148 A |
| D433,463 | S | * | 11/2000 | Dalbo | D19/86 |
| 6,921,073 | B2 | * | 7/2005 | Chabot | A63F 1/10 24/303 |
| D509,162 | S | * | 9/2005 | Barnes | D11/11 |
| 7,267,612 | B2 | * | 9/2007 | Alcorn | A63F 13/08 463/13 |
| 7,287,647 | B1 | * | 10/2007 | Licciardi | A63F 3/00895 206/315.1 |
| D715,366 | S | * | 10/2014 | Pamphilis | D21/392 |

* cited by examiner

BINGO CARD HOLDER SYSTEM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of sports, games, and amusements including board games, more specifically, a supporting structure for a board game further comprising connections between modules.

SUMMARY OF INVENTION

The bingo card holder system is configured for use in a game of bingo. The game of bingo further comprises one or more bingo cards and a plurality of bingo markers. The bingo card holder system organizes the one or more bingo cards. The bingo card holder system displays each of the one or more bingo cards. The bingo card holder system secures each of the one or more bingo cards in a fixed position during game play. The bingo card holder system comprises a master surface and a fastening loop. The master surface is a modular structure that receives, displays and secures the one or more bingo cards such that the position of each of the one or more bingo cards does not shift during game play. The fastening loop is used to truss the modules of the master surface during storage.

These together with additional objects, features and advantages of the bingo card holder system will be readily apparent to those of ordinary skill in the art upon reading the following detailed description of the presently preferred, but nonetheless illustrative, embodiments when taken in conjunction with the accompanying drawings.

In this respect, before explaining the current embodiments of the bingo card holder system in detail, it is to be understood that the bingo card holder system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the bingo card holder system.

It is therefore important that the claims be regarded as including such equivalent construction insofar as they do not depart from the spirit and scope of the bingo card holder system. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
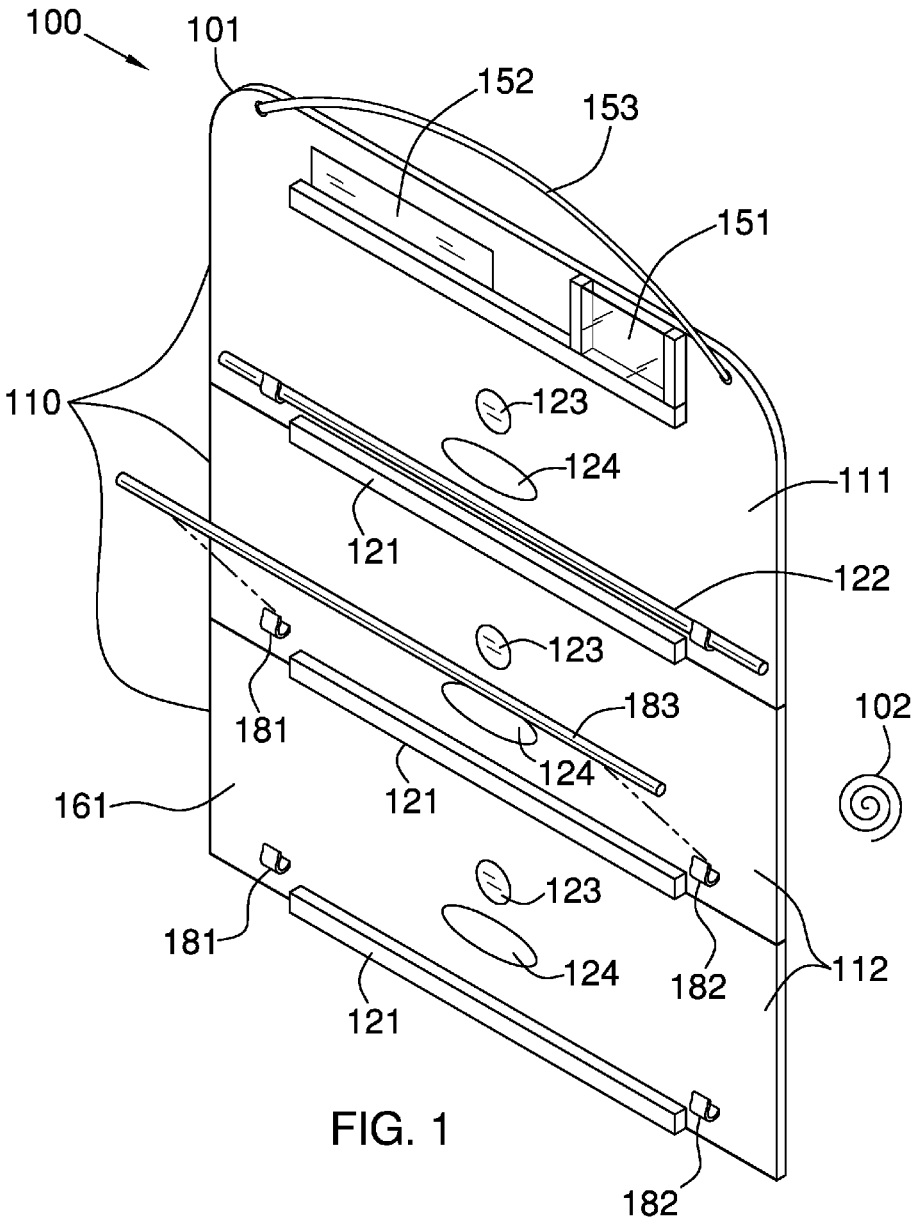
FIG. 1 is a perspective view of an embodiment of the disclosure.
Figure 2:
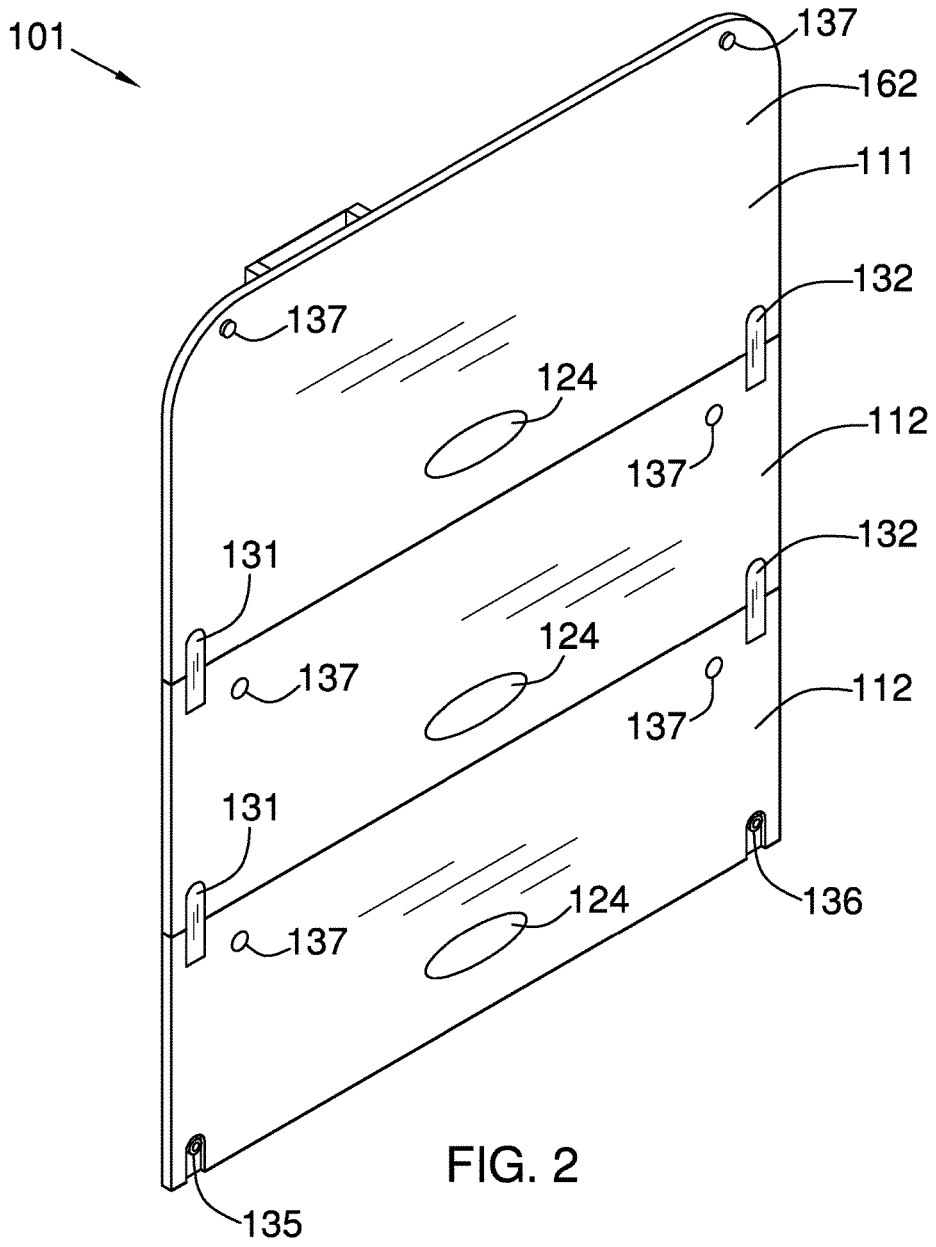
FIG. 2 is a reverse perspective view of an embodiment of the disclosure.
Figure 3:
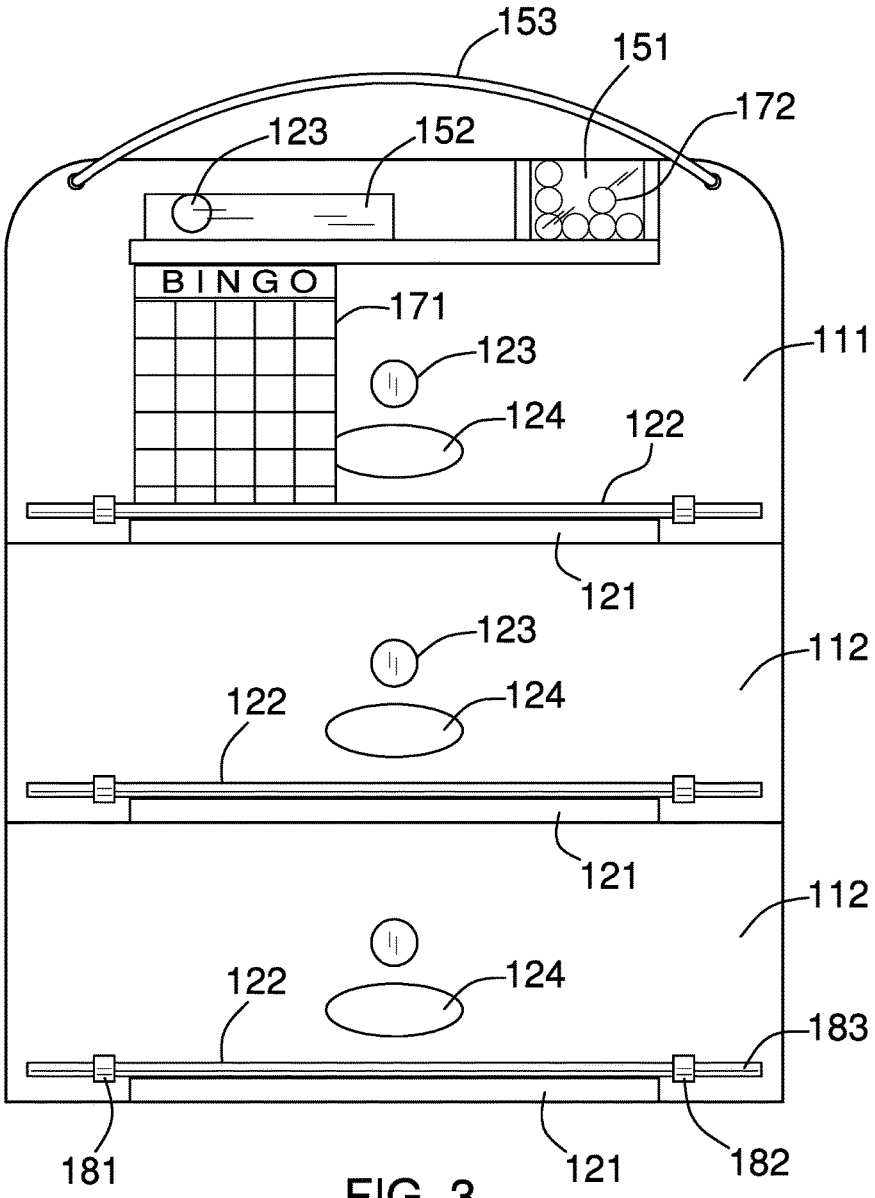
FIG. 3 is an anterior view of an embodiment of the disclosure.
Figure 4:
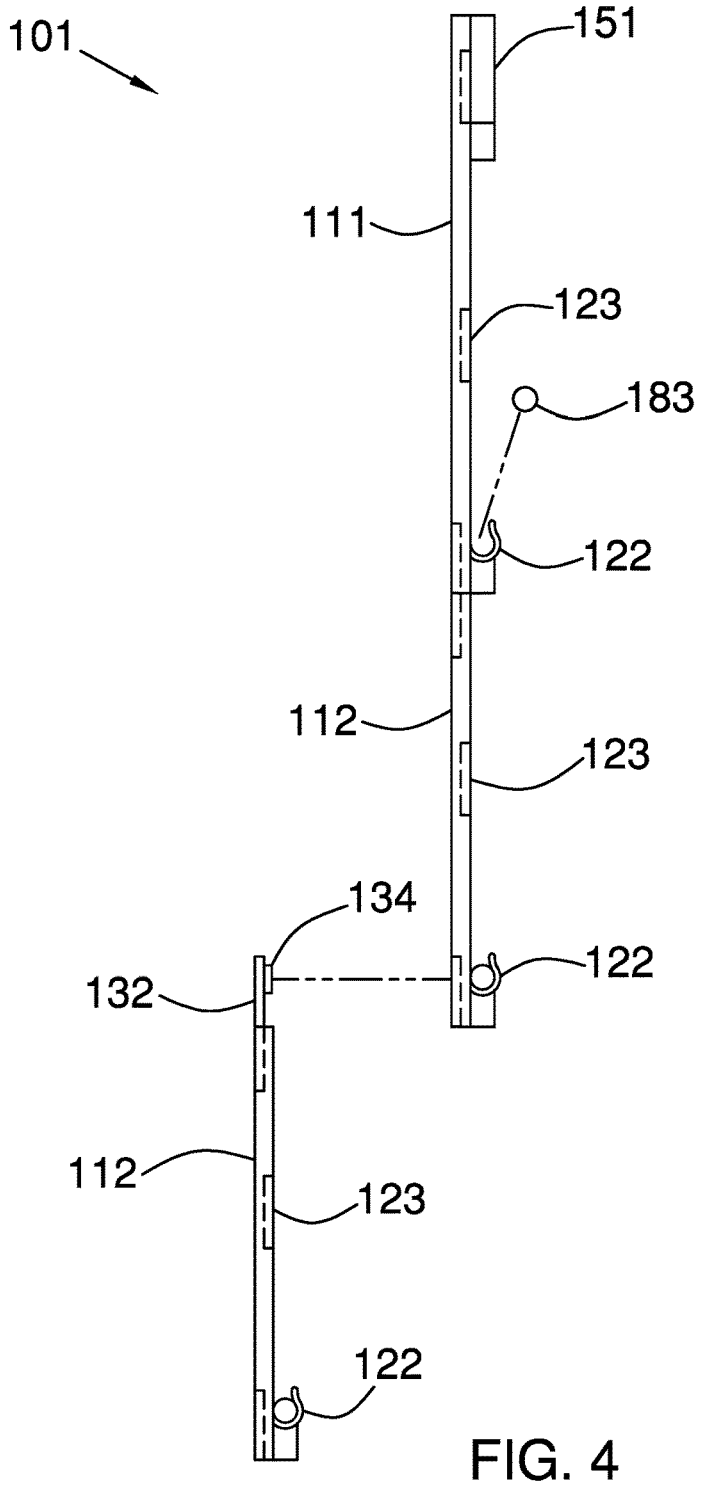
FIG. 4 is a side view of an embodiment of the disclosure.
Figure 5:
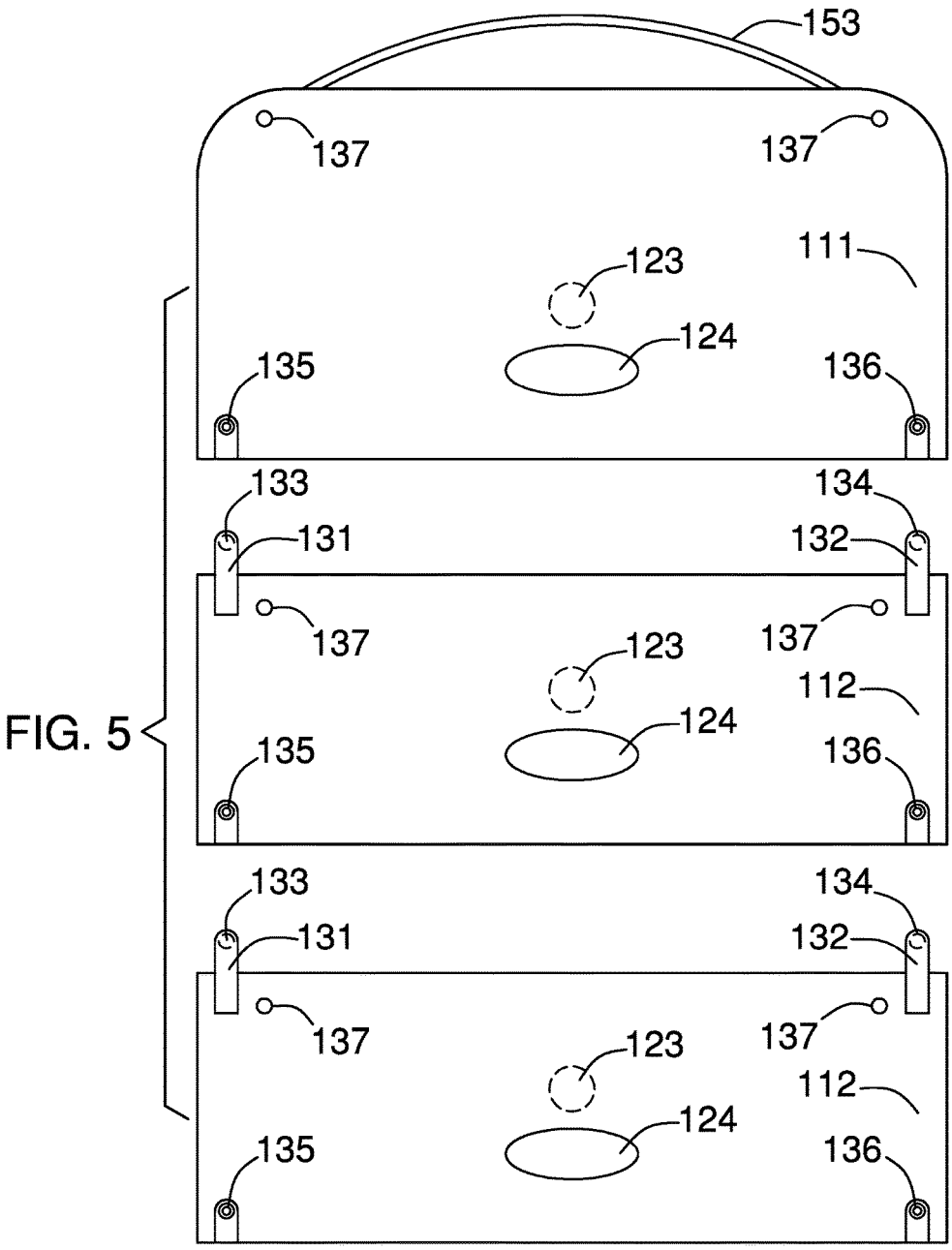
FIG. 5 is an exploded posterior view of an embodiment of the disclosure.
Figure 6:
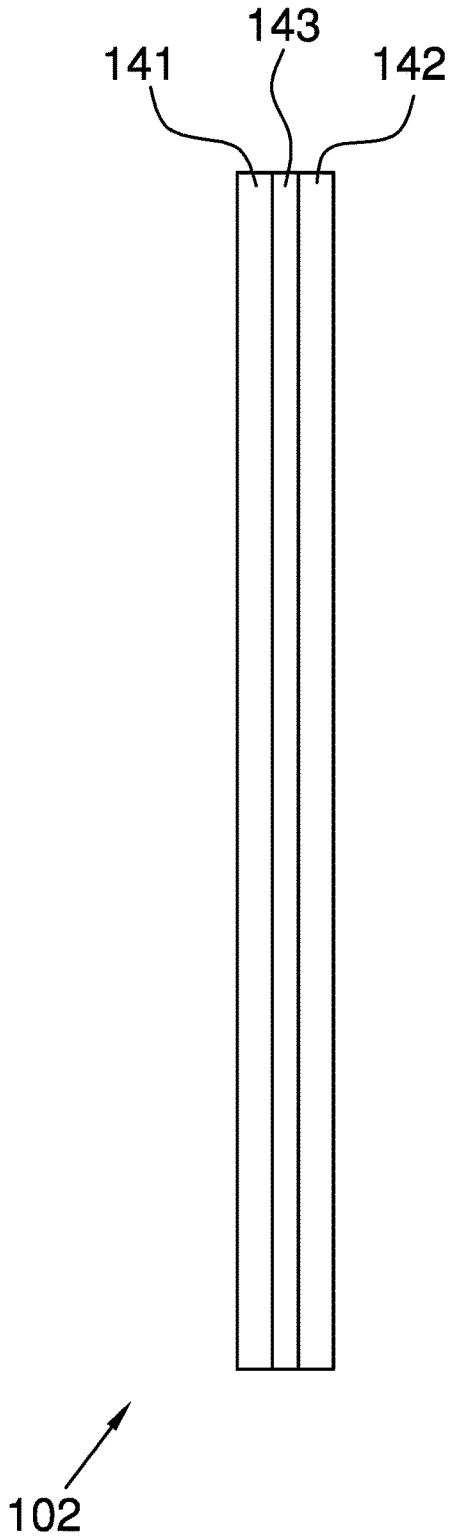
FIG. 6 is a detail view of an embodiment of the disclosure.

Detailed reference will now be made to one or more potential embodiments of the disclosure, which are illustrated in FIGS. 1 through 6.

The bingo card holder system 100 (hereinafter invention) is configured for use in a game of bingo. The game of bingo further comprises one or more bingo cards 171 and a plurality of bingo markers 172. Each of the one or more bingo cards 171 is a well-known and documented document commonly used in the game of bingo. The plurality of bingo markers 172 are transparent tokens used to track game progress in the game of bingo. The invention 100 organizes the one or more bingo cards 171. The invention 100 displays each of the one or more bingo cards 171. The invention 100 secures each of the one or more bingo cards 171 in a fixed position during game play.

The invention 100 comprises a master surface 101 and a fastening loop 102. The master surface 101 is a modular structure that receives, displays and secures the one or more bingo cards 171 such that the position of each of the one or more bingo cards 171 does not shift during game play. The fastening loop 102 is used to truss the modules of the master surface 101 during storage.

The master surface 101 is a plate shaped structure. Each of the one or more bingo cards 171 mounts on the master surface 101 during game play. The master surface 101 is a modular structure that is assembled for game play and disassembled for storage. The modular structure of the master surface 101 is formed from one or more leaves 110. Each of the one or more leaves 110 is further defined with an anterior surface 161 and a posterior surface 162. The one or more leaves 110 is further organized into a superior leaf 111 and one or more inferior leaves 112. The superior leaf 111 and the one or more inferior leaves 112 are interconnected to form a flush surface upon which the one or more bingo cards 171 may be mounted. The one or more inferior leaves 112 are identical.

The anterior surface 161 is the surface of the master surface 101 that is distal from the posterior surface 162. The posterior surface 162 is the surface of the master surface 101 that is placed on a horizontal surface during game play.

Each of the one or more leaves 110 is a rectangular plate. The rectangular plate may be or may not be rounded. Each leaf selected from the one or more leaves 110 attaches to a second leaf selected from the one or more leaves 110. Each leaf selected from the one or more leaves 110 is further able to attach to a third leaf selected from the one or more inferior leaves 112.

The anterior surface 161 of each of the one or more leaves 110 comprises a shelf 121, a panel securing rod 122, a magnet 123, and a truss slot 124.

The shelf 121 is a rectangular block structure. The shelf 121 mounts on the anterior surface 161 of each leaf selected from the one or more leaves 110. The shelf 121 mounts such that the length of the shelf 121 runs perpendicular to the superior-inferior direction of the master surface 101. The shelf 121 forms a barrier that prevents the position of the one or more bingo cards 171 from shifting during game play.

The panel securing rod 122 is a shaft 183 placed on top of the one or more bingo cards 171 to hold the one or more bingo cards 171 in position during game play.

The magnet 123 is a commercially available magnet. The magnet 123 removably inserts into the center of the anterior surface 161 of each leaf selected from the one or more leaves 110. The installation of the magnet 123 is flush with the anterior surface 161 of the selected leaf. Each magnet 123 of any given leaf will attract each magnet 123 contained within the leaves remaining in the one or more leaves 110. The interaction between magnets 123 is used to align each of the one or more leaves 110 of the master surface 101 during storage.

The truss slot 124 is an aperture that is formed through each of the one or more leaves 110 from the anterior surface 161 through to the posterior surface 162. When the invention 100 is disassembled, each of the one or more leaves 110 stacks upon each other such that the centers of each truss slot 124 of each of the one or more leaves 110 are aligned. The one or more leaves 110 are trussed by inserting the fastening loop 102 through the truss slot 124 of each of the one or more leaves 110 and then securing the fastening loop 102 to itself to form a loop.

The posterior surface 162 of each of the one or more inferior leaves 112 comprises a first tab 131, a second tab 132, a first mortise 135, a second mortise 136, and a plurality of non-skid pads 137. The first tab 131 further comprises a first tenon 133. The second tab 132 further comprises a second tenon 134. The posterior surface 162 of the superior leaf 112 comprises a first mortise 135, a second mortise 136, and a plurality of non-skid pads 137 that are identical to the first mortise 135, the second mortise 136, and the plurality of non-skid pads 137 provisioned with each of the plurality of inferior leaves 112.

The first tab 131 is a rectilinear surface that projects away from the superior edge of any inferior leaf selected from the one or more inferior leaves 112. The posterior surface 162 of the first tab 131 is flush with the posterior surface 162 of the selected inferior leaf to which the first tab 131 is attached. The second tab 132 is a rectilinear surface that projects away from the superior edge of any inferior leaf selected from the one or more inferior leaves 112. The posterior surface 162 of the second tab 132 is flush with the posterior surface 162 of the selected inferior leaf to which the second tab 132.

The first tenon 133 is a cylindrical structure that projects perpendicularly away from the first tab 131 in the direction of the anterior surface 161 of the selected inferior leaf. The second tenon 134 is a cylindrical structure that projects perpendicularly away from the second tab 132 in the direction of the anterior surface 161 of the selected inferior leaf.

The first mortise 135 is a cavity formed in the posterior surface 162 of each of the one or more leaves 110 including the superior leaf 111. The first mortise 135 is sized such that the first tenon 133 can be snapped into the first mortise 135 to attach a first leaf selected from the one or more leaves 112 to a second leaf selected from the one or more leaves 110. The first mortise 135 is centered within a channel. The channel is a negative space that is sized to receive the first tab 131 such that the posterior surface 162 of the anterior surface 161 is flush with the posterior surface 162 of a second selected leaf when the first tenon 133 of a first selected leaf is inserted into the first mortise 135 of the second selected leaf.

The second mortise 136 is a cavity formed in the posterior surface 162 of each of the one or more leaves 110 including the superior leaf 111. The second mortise 136 is sized such that the second tenon 134 can be snapped into the second mortise 136 to attach a first leaf selected from the one or more inferior leaves 112 to a second leaf selected from the one or more leaves 110. The second mortise 136 is centered within a channel. The channel is a negative space that is sized to receive the second tab 132 such that the posterior surface 162 of the anterior surface 161 is flush with the posterior surface 162 of a second selected leaf when the second tenon 134 of a first selected leaf is inserted into the second mortise 136 of the second selected leaf.

Each of the plurality of non-skid pads 137 is a commercially available non-skid material that is attached to the posterior surface 162 of each leaf selected from the one or more leaves 110. The plurality of non-skid pads 137 prevents the invention 100 from inadvertently shifting during game play.

The superior leaf 111 is a leaf selected from the one or more leaves 110, and is designated to form the superior edge of the master surface 101. The superior edge of the master surface 101 is the edge that is oriented as the header of a page when the one or more bingo cards 171 are mounted on the master surface 101. The superior leaf 111 further comprises a storage pocket 151, a magnet bay 152, and a handle 153.

The storage pocket 151 is a compartment formed on the anterior surface 161 of the superior leaf 111. The storage pocket 151 is used to store the plurality of bingo markers 172 during game play. The magnet bay 152 is a strip attached to the anterior surface 161 of the superior leaf 111. The magnet bay 152 is formed from a magnetic material. Each magnet 123 removed from a leaf selected from the one or more leaves 110 attaches to the magnet bay 152. The handle 153 is a cord that attaches to the superior edge of the superior leaf 111.

The first clip 181 is a hook that attaches to the anterior surface 161 of the selected leaf. The second clip 182 is a hook that attaches to the anterior surface 161 of the selected leaf. The shaft 183 is a cylindrical shaft that inserts into the first clip 181 and the second clip 182. The first clip 181 and the second clip 182 are formed from an elastomeric material such that the shaft 183 snaps into the first clip 181 and the second clip 182. The shaft 183 deforms the first clip 181 such that the forces generated by the first clip 181 returning to its relaxed shape secure the shaft 183 to the first clip 181. The shaft 183 deforms the second clip 182 such that the forces generated by the second clip 182 returning to its relaxed shape secure the shaft 183 to the second clip 182.

The fastening loop 102 is a loop structure that trusses the master surface 101 after disassembly.

In the first potential embodiment of the disclosure, the fastening loop 102 is a hook and loop fastener that comprises a first hook/loop surface 141, a second hook/loop surface 142, and an adhesive binding 143. The first hook/loop surface 141 and the second hook/loop surface 142 are joined to form the fastening loop 102. Specifically, the inert surface of the strap that forms the first hook/loop surface 141 attaches to the inert surface of the strap that forms the second hook/loop surface 142. An adhesive binding 143 joins the inert surface of the first hook/loop surface 141 to the inert surface of the second hook/loop surface 142. The fastening loop 102 is attached to itself by pressing the first hook/loop surface 141 against the second hook/loop surface 142. Hook and loop fasteners, including hook/loop surfaces such as the first hook/loop surface 141 and the second hook/loop surface 142 are discussed in greater detail elsewhere in this disclosure.

To attach a first leaf selected from the one or more leaves 110 to a second leaf selected from the one or more leaves 110, the first tenon 133 of the first tab 131 of the first leaf inserts into the first mortise 135 of the second leaf in the manner of a snap. The second tenon 134 of the second tab 132 of the first leaf inserts into the second mortise 136 of the second leaf in the manner of a snap. The posterior surface 162 of the one or more leaves 110 is then placed directly on a horizontal surface for game play.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Anterior: As used in this disclosure, anterior is a term that is used to refer to the front side or direction of a structure. When comparing two objects, the anterior object is the object that is closer to the front of the structure.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Clip: As used in this disclosure, a clip is a fastener that attaches to an object by gripping or clasping the object. A clip typically comprises a spring function.

Elastic: As used in this disclosure, an elastic is a material or object that deforms when a force is applied to it and that is able to return to its relaxed shape after the force is removed. A material that exhibits these qualities is also referred to as an elastomeric material.

Fastener: As used in this disclosure, a fastener is a device that is used to join or affix two objects. Fasteners comprise a first element which is attached to the first object and a second element which is attached to the second object such that the first element and the second element join to affix the first object and the second object.

Flush: As used in this disclosure, the term flush is used to describe the alignment of a first surface and a second surface on a single plane.

Form Factor: As used in this disclosure, the term form factor refers to the size and shape of an object.

Hook: As used in this disclosure, a hook is an object that is curved or bent at an angle such that items can be hung on or caught by the object.

Hook and Loop Fastener: As used in this disclosure, a hook and loop fastener is a fastener that comprises a hook surface and a loop surface. The hook surface comprises a plurality of minute hooks. The loop surface comprises a surface of uncut pile that acts like a plurality of loops. When the hook surface is applied to the loop surface, the plurality of minute hooks fastens to the plurality of loops securely fastening the hook surface to the loop surface. A note on usage: when fastening two objects the hook surface of a hook and loop fastener will be placed on the first object and the matching loop surface of a hook and loop fastener will be placed on the second object without significant regard to which object of the two objects is the first object and which of the two objects is the second object. When the hook surface of a hook and loop fastener or the loop surface of a hook and loop fastener is attached to an object this will simply be referred to as the "hook/loop surface" with the understanding that when the two objects are fastened together one of the two objects will have a hook surface and the remaining object will have the loop surface.

Inferior: As used in this disclosure, the term inferior refers to an edge or surface of an object that would commonly be referred to as the bottom of the object.

Loop: As used in this disclosure, a loop is the length of a first linear structure including, but not limited to, shafts, lines, cords, or ribbons, that is: 1) folded over and joined at the ends forming an enclosed space; or, 2) curved to form a closed or nearly closed space within the first linear structure. In both cases, the space formed within the first linear structure is such that a second linear structure such as a line, cord or a hook can be inserted through the space formed within the first linear structure. Within this disclosure, the first linear structure is said to be looped around the second linear structure.

Modular: As used in this disclosure, modular refers to a system of assembly of a structure from modules Module: As used in this disclosure, a module refers to an independent subunit of a larger structure. Modules are often interchangeable in a manner that allows the form factor or function of the larger structure to be customized.

Mortise: As used in this disclosure, a mortise is a cavity formed in a material that is designed to receive a similarly shaped object such that the similarly shaped object is flush with the surface of the material.

Negative Space: As used in this disclosure, negative space is a method of defining an object through the use of open or empty space as the definition of the object itself, or, through the use of open or empty space to describe the boundaries of an object.

Non-Skid Material: As used in this disclosure, a non-skid material is a commercially available product that can be applied to an object such that the object is inhibited from sliding along the surface upon which the object is resting.

Plate: As used in this disclosure, a plate is a smooth, flat and semi-rigid or rigid structure that has at least one dimension that: 1) is of uniform thickness; and, 2) that appears thin relative to the other dimensions of the object. Plates often have a rectangular or disk like appearance. As defined in this disclosure, plates may be made of any material, but are commonly made of metal. When made of wood, a plate is often referred to as a board.

Posterior: As used in this disclosure, posterior is a term that is used to refer to the side of an object that is distal or in the opposite direction of the anterior side. When comparing two items, the posterior item is the item that is distal from the front of the object.

Rounded: A used in this disclosure, the term rounded refers to the replacement of an apex, vertex, or edge or brink of a structure with a (generally smooth) curvature wherein the concave portion of the curvature faces the interior or center of the structure.

Rounded Rectangle: A used in this disclosure, a rounded rectangle is a rectangle wherein one or more of the corner structures of the rectangle are replaced with a curvature wherein the concave portion of the curvature faces the center of the rounded rectangle.

Shaft: As used in this disclosure, a shaft is a long, narrow and rigid cylindrical structure.

Snap: As used in this disclosure, a snap is a fastener that comprises a male component and a female component. The snap is engaged by pressing the male component into the female component.

Spring: As used in this disclosure, a spring is a device that is used to store mechanical energy. This mechanical energy will often be stored by: 1) deforming an elastomeric material that is used to make the device; 2) the application of a torque to a rigid structure; or 3) a combination of the previous two items.

Superior: As used in this disclosure, the term superior refers to an edge or surface of an object that would commonly be referred to as the top of the object.

Tenon: As used in this disclosure, a tenon is a structure that projects away from an edge a first object (often the end of a piece of wood). The tenon is sized and shaped to fit into a mortise that is formed in a second object such that the first object can be attached to the second object by inserting the tenon in the matching mortise.

Truss: As used in this disclosure, the term truss means to gather or secure in materials in a bundle.

With respect to the above description, it is to be realized that the optimum dimensional relationship for the various components of the invention described above and in FIGS. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A supporting structure for a board game comprising:
- a master surface and a fastening loop;
- wherein the master surface is a modular structure;
- wherein the fastening loop trusses the modules of the master surface;
- wherein the supporting structure for a board game is configured for use in a game of bingo;
- wherein the game of bingo further comprises one or more bingo cards and a plurality of bingo markers;
- wherein the supporting structure for a board game organizes the one or more bingo cards;
- wherein the supporting structure for a board game secures each of the one or more bingo cards in a fixed position during game play;
- wherein the master surface is a plate structure;
- wherein each of the one or more bingo cards mounts on the master surface;
- wherein the modular structure of the master surface is formed from one or more leaves;
- wherein each of the one or more leaves is further defined with an anterior surface and a posterior surface;
- wherein the one or more leaves are further organized into a superior leaf and one or more inferior leaves;
- wherein the superior leaf and the one or more inferior leaves are interconnected to form a flush surface upon which the one or more bingo cards mount;
- wherein the one or more inferior leaves are identical;
- wherein the superior leaf and the one or more inferior leaves combine to form a superior inferior direction;
- wherein each of the one or more leaves is a rectangular plate;
- wherein each leaf selected from the one or more leaves attaches to a second leaf selected from the one or more leaves;
- wherein each leaf selected from the one or more leaves is further able to attach to a third leaf selected from the one or more inferior leaves;
- wherein the anterior surface of each of the one or more leaves comprises a shelf, a panel securing rod, a magnet, and a truss slot;
- wherein the shelf, the panel securing rod, and the magnet attach to the anterior surface of their associated leaf;
- wherein the truss slot is formed in the anterior surface of its associated leaf.

2. The supporting structure for a board game according to claim 1
- wherein the shelf is a rectangular block structure;
- wherein the shelf mounts on the anterior surface of each leaf selected from the one or more leaves;
- wherein the shelf mounts on the anterior surface of its associated leaf such that the length of the shelf runs perpendicular to the superior-inferior direction;
- wherein the shelf forms a barrier that prevents the position of the one or more bingo cards from shifting during game play.

3. The supporting structure for a board game according to claim 2 wherein the panel securing rod is placed on top of the one or more bingo cards.

4. The supporting structure for a board game according to claim 3
- wherein the magnet removably inserts into the center of the anterior surface of its associated;
- wherein the magnet is flush with the anterior surface of the associated leaf.

5. The supporting structure for a board game according to claim 4
- wherein each magnet of any given leaf is positioned such that any first magnet will attract any second magnet contained within the one or more leaves such that
- wherein the interaction between magnets aligns each of the one or more leaves of the master surface for storage.

6. The supporting structure for a board game according to claim 5 wherein the truss slot is an aperture formed through each of the one or more leaves from the anterior surface through to the posterior surface;

wherein the one or more leaves are trussed by inserting the fastening loop through the truss slot of each of the one or more leaves and then securing the fastening loop to itself.

7. The supporting structure for a board game according to claim 6 wherein the posterior surface of each of the one or more inferior leaves comprises a first tab, a second tab, a first mortise, a second mortise, and a plurality of non-skid pads;

wherein the first tab, the second tab, and the plurality of non-skid pads attach to the posterior surface of the associated inferior leaf;

wherein the first mortise and the second mortise are formed in the associated inferior leaf.

8. The supporting structure for a board game according to claim 7 wherein the posterior surface of the superior leaf comprises a first mortise, a second mortise, and a plurality of non-skid pads;

wherein the first mortise and the second mortise are formed in the posterior surface of the superior leaf;

wherein the plurality of non-skid pads attach to the posterior surface of the superior leaf;

wherein the first mortise, the second mortise, and the plurality of non-skid pads are identical to the first mortise, the second mortise, and the plurality of non-skid pads associated with each of the plurality of inferior leaves.

9. The supporting structure for a board game according to claim 8 wherein the first tab further comprises a first tenon;

wherein the second tab further comprises a second tenon;

wherein the first tab is a rectilinear surface that projects away from the superior edge of any inferior leaf selected from the one or more inferior leaves;

wherein the posterior surface of the first tab is flush with the posterior surface of the selected inferior leaf to which the first tab is attached;

wherein the second tab is a rectilinear surface that projects away from the superior edge of any inferior leaf selected from the one or more inferior leaves;

wherein the posterior surface of the second tab is flush with the posterior surface of the selected inferior leaf to which the second tab;

wherein the first tenon is a cylindrical structure that projects perpendicularly away from the first tab in the direction of the anterior surface of the selected inferior leaf;

wherein the second tenon is a cylindrical structure that projects perpendicularly away from the second tab in the direction of the anterior surface of the selected inferior leaf.

10. The supporting structure for a board game according to claim 9 wherein the first mortise is a cavity;

wherein the second mortise is a cavity;

wherein the first mortise is sized such that the first tenon snaps into the first mortise;

wherein the second mortise is sized such that the second tenon snaps into the second mortise.

11. The supporting structure for a board game according to claim 10 wherein the first mortise is centered within a channel;

wherein the second mortise is centered within a channel;

wherein the channel is sized to receive the first tab such that the posterior surface of the anterior surface is flush with the posterior surface of a second selected leaf when the first tenon of a first selected leaf inserts into the first mortise of the second selected leaf;

wherein the channel is a negative space that is sized to receive the second tab such that the posterior surface of the anterior surface is flush with the posterior surface of a second selected leaf when the second tenon of a first selected leaf inserts into the second mortise of the second selected leaf.

12. The supporting structure for a board game according to claim 11 wherein the superior leaf further comprises a storage pocket, a magnet bay, and a handle;

wherein the storage pocket is a compartment formed on the anterior surface of the superior leaf;

wherein the magnet bay is a strip attached to the anterior surface of the superior leaf;

wherein the magnet bay is formed from a magnetic material;

wherein any magnet removed from a leaf selected from the one or more leaves attaches to the magnet bay;

wherein the handle is a cord that attaches to an edge of the superior leaf.

13. The supporting structure for a board game according to claim 12 wherein the panel securing rod further comprises a first clip; a second clip; and a shaft;

wherein the first clip is a hook that attaches to the anterior surface of the associated leaf;

wherein the second clip is a hook that attaches to the anterior surface of the associated leaf;

wherein the shaft is a cylindrical shaft that inserts into the first clip and the second clip.

14. The supporting structure for a board game according to claim 13 wherein the first clip and the second clip are formed from an elastomeric material such that the shaft snaps into the first clip and the second clip;

wherein the shaft deforms the first clip such that the forces generated by the first clip returning to its relaxed shape secure the shaft to the first clip;

wherein the shaft deforms the second clip such that the forces generated by the second clip returning to its relaxed shape secure the shaft to the second clip.

15. The supporting structure for a board game according to claim 14 wherein the fastening loop is a hook and loop fastener that further comprises a first hook/loop surface, a second hook/loop surface, and an adhesive binding;

wherein the inert surface of a strap that forms the first hook/loop surface attaches to the inert surface of a strap that forms the second hook/loop surface;

wherein an adhesive binding joins the inert surface of the first hook/loop surface to the inert surface of the second hook/loop surface;

wherein the fastening loop is attached to itself by pressing the first hook/loop surface against the second hook/loop surface.

* * * * *